US006078775A

United States Patent [19]

Arai et al.

[11] Patent Number: 6,078,775

[45] **Date of Patent: *Jun. 20, 2000**

[54] INTERMEDIATE TRANSFER BODY AND IMAGE FORMING APPARATUS USING THE INTERMEDIATE TRANSFER BODY

[75] Inventors: Kazuhiko Arai; Ryuji Katsuno; Masanori Kobayashi; Chikara Ando; Tatsuo Okuno; Nobuhiro Katsuta, all of Nakai-machi, Japan

[73] Assignee: Fuji Xerox Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/110,266

[22] Filed: Jul. 6, 1998

[30] Foreign Application Priority Data

Jul. 7, 1997 [JP] Japan ..... 9-181596
Jun. 24, 1998 [JP] Japan ..... 10-177443

[51] Int. Cl.[7] ..... G03G 15/14

[52] U.S. Cl. ..... 399/308; 399/302

[58] Field of Search ..... 399/297, 302, 399/308

[56] References Cited

U.S. PATENT DOCUMENTS 2,990,278 6/1961 Carlson ..... 430/124
5,519,475 5/1996 Miyamoto et al. ..... 399/308
5,530,532 6/1996 Iino et al. ..... 399/308 X
5,835,830 11/1998 Fukuda et al. ..... 399/308 X

FOREIGN PATENT DOCUMENTS 46-41679 12/1971 Japan .
59-50473 3/1984 Japan .
2-108072 4/1990 Japan .
5-19642 1/1993 Japan .
5-249798 9/1993 Japan .
5-333711 12/1993 Japan .

*Primary Examiner*—Fred L. Braun
*Attorney, Agent, or Firm*—Oliff & Berrdige, PLC

[57] ABSTRACT

An intermediate transfer body to be used in an image forming apparatus for transferring and fixing a toner image from a photosensitive body onto a recording medium using an intermediate transfer body having the surface of a material such as silicone rubber which image forming apparatus reduces the friction coefficient between the photosensitive body and the intermediate transfer body to allow easy driving running control of the intermediate transfer body, and reduces the fog toner transfer rate to prevent deterioration of the image quality when the medium (40 to 70%) gloss is employed, and an image forming apparatus using the intermediate transfer body are provided. The intermediate transfer body, which receives a toner image held on a toner image carrier and transfers again the toner image onto a recording medium to form an image on the recording medium, has the surface for receiving the transfer of a toner image on which the peak area and roughed recess area are formed mixedly.

6 Claims, 13 Drawing Sheets

INTERMEDIATE TRANSFER BODY AND IMAGE FORMING APPARATUS USING THE INTERMEDIATE TRANSFER BODY

BACKGROUND OF THE INVENTION

1. Field of the Invention

This invention relates to an image forming apparatus such as a printer or copying machine involving a method in which a toner image formed on a photosensitive body is first transferred onto an intermediate transfer body, and the first transferred toner image on the intermediate transfer body is transferred and fixed on a recording paper.

2. Description of the Related Art

Conventional image forming apparatuses used widely utilizing the conventional image forming technique, for example, in which an electrostatic latent image is formed on a photosensitive body, the latent image is developed with dry toner to form a toner image, the toner image is transferred and fixed electrostatically onto a recording medium, are disadvantageous in that uneven photographic density is caused, or powder toner is scattered in a transfer area, and an image is poor in resolution and dot reproducibility.

These disadvantages are largely due to the transfer process for transferring a toner image formed on a photosensitive body onto a recording medium electrostatically. In detail, in the transfer method utilizing an electrostatic transfer system, it is difficult to transfer a toner image formed on a photosensitive body uniformly and efficiently. The toner transfer efficiency increases with increasing electric field (referred to as Et hereinafter) applied to the toner layer, however, the transfer efficiency and Et turn to decrease at the certain electric field due to Paschen discharge. In other words, the transfer efficiency has a peak at a certain Et value. The peak value of the transfer efficiency is not 100% but is at most 95%. Because the transfer efficiency of a toner layer depends on Et, unless Et is maintained constant independently on the evenness of a toner layer and a recording medium typically such as a paper, and evenness electrical property, the resultant transfer efficiency becomes different depending on the thickness of the toner layer and transfer position of the recording medium. In the case that a toner image formed on a recording medium is monochrome and has a thin layer thickness, the uneven recording medium and uneven electrical property cause an uneven image. The same is true for transfer process in which a plurality of monochrome toner images formed independently on photosensitive bodies are transferred onto a recording medium one on another, an uneven recording medium and uneven electrical property result in an uneven image. In other words, though the difference between a portion where a plurality of toner images are transferred one on another and a portion where a monochrome toner image is transferred but multi-colors are not transferred can be suppressed electrostatically, the unevenness of a recording medium and unevenness of electrical property cannot be compensated.

On the other hand, in transfer using the intermediate transfer body in which monochrome color images formed independently on photosensitive bodies are transferred onto an intermediate transfer body having no unevenness and controlled property one on another, an even image is obtained on the intermediate transfer body. The toner image on the intermediate transfer body is multi-layered, and composed of maximum three-layers and minimum one or less layer depending on the portion. It is difficult to apply a constant electric field to transfer electrostatically these toner layers simultaneously and unevenly on recording paper which is typical of the recording medium, and Et is uneven. As the result, in electrostatic image transfer process, not all the color image formed on an intermediate transfer body formed one on another is transferred onto a recording medium, some of the color image remains on the intermediate transfer body. The remaining toner image depends on the toner thickness of the color image formed on the intermediate transfer body. Therefore color balance of the color image obtained on a recording medium is deviated, and the desired color image cannot be obtained. Further, because of irregularity on the surface of the paper namely recording medium, the paper fits on the intermediate transfer body imperfectly to cause uneven gaps, and a transfer electric field is disturbed and toner is scattered due to mutual Coulomb repulsion of powder toner, thus the image quality becomes poor.

To cope with this problem, Japanese Published Examined Patent Application No. Sho 46-41679 discloses a method in which a toner image formed on a photosensitive body is adhered and transferred on an intermediate transfer body consisting of elastic material, and then the toner image is melted by heating and transferred from the intermediate transfer body onto a recording medium. Because a toner image is transferred from an intermediate transfer body onto a recording medium non-electrostatically in this method, the image quality is unlikely to deteriorate so significantly during transfer process as described herein above.

Further, for example, Japanese Published Unexamined Patent Application No. Hei 2-108072 discloses a method in which toner images of different colors are transferred electrostatically on an intermediate transfer body one on another, the multi-color multi-layer toner image is melted on the intermediate transfer body, and then the melted multi-layer toner image is transferred onto a recording medium to obtain a color copy. Because a toner image is transferred non-electrostatically onto a recording medium in this method as well, the image quality is unlikely to deteriorate so significantly. This method is called a transfer fixing method.

Concerning to the image forming apparatus which utilizes this transfer fixing method, U.S. Pat. No. 2,990,278 specification, Japanese Published Unexamined Patent Application No. Hei 5-19642, and Japanese Published Unexamined Patent Application No. Hei 5-249798 disclose an apparatus for transferring in which an intermediate transfer body and a recording medium are thermally brought into tight contact with each other and are pressed in order to transfer completely the toner image from the intermediate transfer body onto the recording medium, then cooled until cohesion between toner particles becomes stronger than the adhesion between toner and the intermediate transfer body, thereafter the recording medium is separated from the intermediate transfer body. According to this method, the high quality image of high toner transfer, excellent color balance and high gloss, and excellent toner transparency is obtained. However, in transfer fixing of toner using this intermediate transfer body, color copying toner currently used adheres on the surface of a member used for heating and melting, that is, so-called offset phenomenon occurs, unless releasing agent such as silicone oil is used.

On the other hand, to utilize effectively the advantage of the intermediate transfer body, various studies have been conducted in relation to the structure of the uppermost layer of the intermediate transfer body.

For example, silicone rubber, fluorine-contained resin, and fluorine-contained rubber which contains fluorine-contained resin dispersed therein are known as heat resistant and toner releasing materials.

Because the intermediate transfer body surface is in contact with the photosensitive body surface in an apparatus which utilizes an intermediate transfer body, a releasing agent such as silicone oil cannot be supplied like the conventional fixing unit. To solve this problem, a method in which a recording medium is separated from an intermediate transfer body after toner is cooled to a temperature lower than the melting point of the toner has been proposed. This method is disclosed in the patents described herein above.

However, because fluorine-contained resin and fluorine-contained rubber which contains fluorine-contained resin dispersed therein used as a surface material of an intermediate transfer body is less adhesive between an intermediate transfer body and a recording medium, toner is separated before the toner is cooled sufficiently to cause offset and uneven gloss. A tight contact means is required to prevent this problem, thus the requirement leads to a complex and large sized apparatus. Because fluorine-contained resin and fluorine-contained rubber which contains fluorine-contained resin dispersed therein are inherently poor in toner releasing property and have hard surface in comparison with silicone rubber, the surface of these materials does not fit to the toner image surface, and a low height toner image located near a high height toner image is not transferred because of large difference in height to cause transfer lacking. Further the difference in toner image height causes the gloss difference to result in uneven gloss. In the case of an image in which fine lines are located closely each other, fire lines are diffused and joined together at some portions. As described herein above, the above-mentioned materials result in poor image quality in comparison with silicone rubber particularly in the case that multi-colors are transferred and fixed as in the case of color image copying.

Therefore, silicone rubber is popularly used as intermediate transfer body surface material for the process in which a color image is transferred from the photosensitive surface onto an intermediate transfer body, and the transferred image is transferred and fixed on a recording paper, because silicone rubber results in good image quality.

However, even though silicone rubber is used as surface material of an intermediate transfer body, a process in which a recording paper is fit to a toner image formed on the intermediate transfer body surface, and then the recording paper is separated from the intermediate transfer body after cooling to a temperature lower than the melting point of the toner should be operated.

While separation after cooling of melted toner results in no offset onto the intermediate transfer body surface, the surface of the toner image on the recording medium separated from the intermediate transfer body surface is a replica of the surface of the intermediate transfer body. In other words, just as making a mold, the surface configuration of the intermediate transfer body is copied on the surface of the toner image, a smooth intermediate transfer body surface results in a high gloss toner image, on the other hand, a roughed cloudy intermediate transfer body surface results in a low gloss toner image. This is the feature of this method.

There are many independent toners called as fog toner other than toner image for forming an image on the photosensitive body surface. Silicone rubber transfers also mostly fog toner on the photosensitive body onto the intermediate transfer body surface because of elasticity and adhesive property of silicone rubber. In the conventional case that a toner image on the photosensitive body surface is transferred directly onto a recording paper utilizing electrostatic force, fog toner is selectively transferred utilizing electrostatic force, and event though it is transferred onto a recording paper, fog toner is unrecognizable.

When an intermediate transfer body having a silicon rubber coating is used, fog toner is mostly transferred and fixed on a recording medium to result in the poor image quality. Such poor image quality is a problem.

Because of excellent leveling property of silicone rubber, silicone rubber coated on an intermediate transfer body surface forms a very smooth surface. The friction efficiency between silicone rubber and the smooth surface of a photosensitive body is very high. For forming a color image namely copying or printing, a color is synthesized by using three or more color toner images formed one on another. In this case, the registration of each color, namely position deviation, affects strongly the image quality. The smooth intermediate transfer body surface gives a high friction coefficient between a photosensitive body, and causes slipping between a driving roller for driving the intermediate transfer body and the back side of the intermediate transfer body. High friction coefficient between the driving roller and the back side of the intermediate transfer body for increasing the driving force often causes waving of the intermediate transfer body due to mutual tension between intermediate transfer body and photosensitive body to result in non-flat surface of the intermediate transfer body because of inconsistency between the direction of a force exerted from the driving roller and the direction of a force exerted from the photosensitive body due to poor mechanical accuracy though it causes no problem if both force directions are coincident. As the result, the toner image on the photosensitive body is not transferred as it is to cause a defective image. Such defective image is a problem.

To reduce the friction coefficient of rubber, method in which the surface is roughed is used. Some methods have been known. One of these methods is a spray coating method in which spray condition for spraying silicone rubber is selected so that atomization of silicone rubber is unlikely to occur by changing, for example, coating condition such as temperature, humidity, and spray distance, and viscosity of silicone rubber, and then a rough surface is obtained. By applying this method, micro-waving surface is obtained but the wave surface is smooth, the resultant friction coefficient is still large. Blasting treatment, in which sands or steel particles are blasted onto a surface, roughs the entire surface so as to make recesses on the rubber surface, the friction coefficient decreases only slightly. The fog toner transfer is not reduced. The image gloss is reduced significantly, and the surface is difficult to rough evenly to cause unevenness, and the image quality becomes poor. Other coating methods such as blade coating and dip coating also result in long swell with smooth mirror-like surface, the problem which the inventors of this invention addressed on is not solved.

Japanese Published Unexamined Patent Application No. Sho 59-50473 mentions the surface roughness of the intermediate transfer body and discloses a method for controlling the surface roughness by spray coating, however, the object of this invention is to improve the life of rubber, so the friction coefficient between an intermediate transfer body and photosensitive body cannot be reduced so significantly as the intermediate transfer body is slipped on the photosensitive body and is controlled, or fog toner transfer cannot be reduced significantly to an unrecognizable level. Japanese Published Unexamined Patent Application No. Hei 5-333711 discloses a method for prescribing the roughness of the intermediate transfer body surface to prevent transferring lacking, however, the surface roughness described in this disclosure is insufficient for obtaining the intermediate transfer body having the silicone rubber surface which satisfies high gloss requirement desirable as the color image and excellent intermediate transfer body driving running controllability requirement for preventing image deviation, namely requirement for low friction coefficient between the intermediate transfer body and photosensitive body and reduced fog toner transfer.

In view of the above-mentioned disadvantage, the inventors of the present invention proposes an intermediate transfer body having the peak area and smooth recess area which is used in an image forming apparatus for transferring and fixing a toner image from a photosensitive body onto a recording medium using the intermediate transfer body having the silicone rubber surface wherein the image gloss is as high as desirable for color image, the friction between the intermediate transfer body and photosensitive body is reduced so that intermediate transfer body driving running control becomes easy, and the fog toner transfer is reduced to prevent the deterioration of image quality, and an image forming apparatus which uses the intermediate transfer body.

However, the image gloss preference is different individually, most prefer high gloss (70% or higher) but some performs medium gloss (40 to 70%), which is currently used color copy machines reproduce usually.

To achieve such medium gloss using an intermediate transfer body having the peak area and smooth recess area proposed by the inventors of the present invention, the peak area is increased, however, an experiment reveals a problem of poor intermediate transfer body driving running performance due to an increased friction coefficient between the intermediate transfer body and the photosensitive body with an increasing contact area between the intermediate transfer body and the photosensitive body.

On the other hand, it is possible to make the intermediate transfer body driving running control easy by reducing the friction coefficient between the intermediate transfer body and the photosensitive body, however, the reduced friction coefficient results in low image gloss of about 20%.

OBJECTS AND SUMMARY OF THE INVENTION

It is the object of the present invention to provide an intermediate transfer body which is use in an image forming apparatus for transferring and fixing a toner image from a photosensitive body to a recording medium using the intermediate transfer body having the silicone rubber surface, wherein the medium image gloss (40 to 70%), which currently is used in color copying machines reproduce usually is employed, the friction coefficient between the intermediate transfer body and photosensitive body is reduced to make the intermediate transfer body driving running control easy, and the fog toner transfer is reduced to prevent deterioration of image quality, and an image forming apparatus provided with the intermediate transfer body.

The intermediate transfer body of the present invention receives a toner image held on a toner image holder and transfers again the toner image onto a recording medium to form an image on the recording medium, wherein the surface of the intermediate transfer body for receiving the toner image has the peak area and roughed recess area mixedly.

The image forming apparatus of the present invention is provided with an electrostatic latent image carrier, an electrostatic latent image forming means for forming an electrostatic latent image on the electrostatic latent image carrier, a developing means for developing the electrostatic latent image formed on the electrostatic latent image carrier with toner to form a toner image, an intermediate transfer body, a transfer means for performing first transfer of the toner image onto the intermediate transfer body, and a second transfer means for transferring the toner image on the intermediate transfer body onto the recording medium by at least heating, wherein the surface of the intermediate transfer body for receiving the toner image has the peak area and roughed recess area mixedly.

The roughness of the roughed surface namely central line average roughness Ra is in a range from 0.1 $\mu$m to 0.6 $\mu$m.

The image forming method of the present invention is a method in which an image forming apparatus provided with an photosensitive body on which an electrostatic latent image is formed, an electrifier for charging the photosensitive body, a latent image forming means for depositing charged toner on the photosensitive body using light information corresponding to image information, and a developing means are used, and the toner image formed on the intermediate transfer body to which the toner image is transferred from the developed photosensitive body is held between the intermediate transfer body and a recording medium, and the toner image is transferred onto the recording paper at least by heating, wherein the intermediate transfer body has the peak area on the surface, and the toner image gloss formed on the recording medium is adjusted by adjusting the surface roughness of the area other than the peak area of the intermediate transfer body surface.

DETAILED DESCRIPTION OF THE PREFERRED EMBODIMENTS

Figure 1:
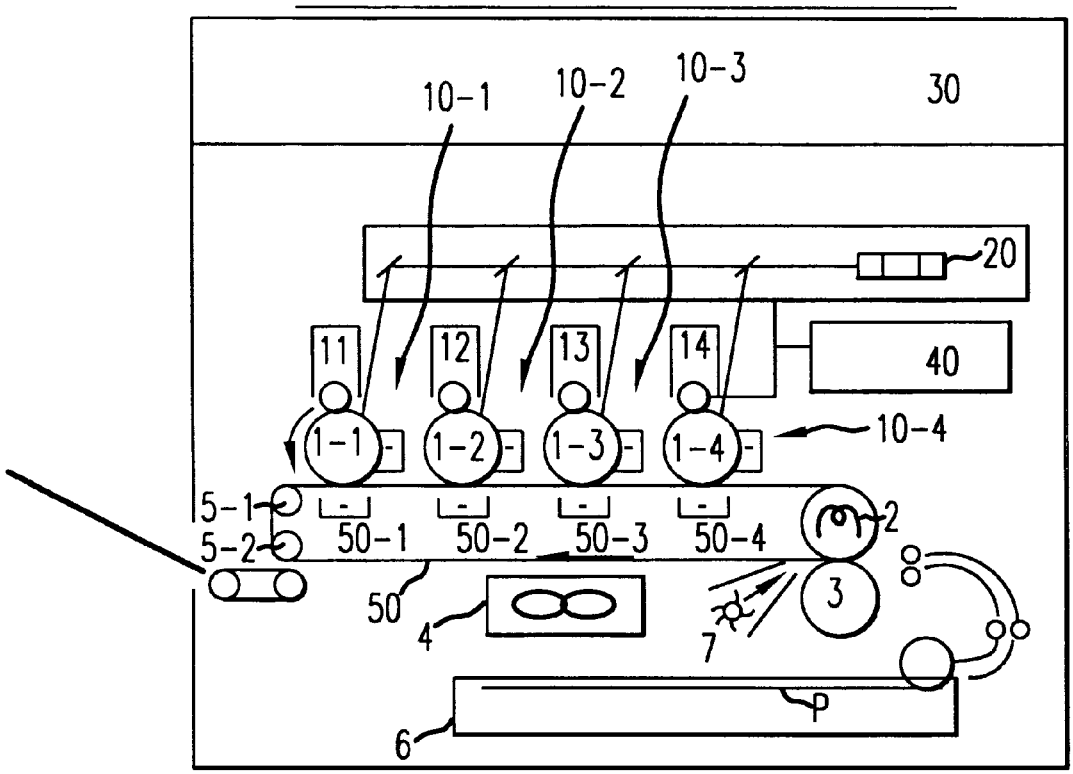
FIG. 1 is a schematic example of an image forming apparatus using an intermediate transfer body.

The present invention will be described in detail hereinafter with reference to the drawings. FIG. 1 shows a schematic example of an image forming apparatus using an intermediate transfer body of the present invention. The character 50 is a belt shaped intermediate transfer body, and the belt comprising a double layer of the base layer and the surface layer is used. While polyimide, polyetherether ketone (PEEK), polyallylene sulfide (PAS), polyimideamide, polyether sulfone (PES), polyether nitrile (PEN), and thermoplastic polyimide have been proposed as a base material of the belt used for the intermediate transfer body, polyimide is used predominantly among these materials because of the excellent heat resistance and mechanical strength, which are required for this application. In this example, polyimide film with a thickness of 80 $\mu$m containing carbon black is used, and the volume resistivity of a base layer is adjusted in a range from $10^8$ Ωcm to $10^{11}$ Ωcm by varying carbon black content in order to transfer a toner image from a photosensitive body onto an intermediate transfer body electrostatically without any irregularity of the image.

The volume resistivity of the surface layer is preferably in a range from $10^{12}$ Ωcm to $10^{15}$ Ωcm to transfer a toner image from a photosensitive body onto an intermediate transfer body electrostatically without any irregularity of the image, and for tight contact between an intermediate transfer body and paper with interposition of a toner image in simultaneous transferring and fixing process and in view of toner releasing and heat resistance, silicone rubber with a rubber hardness of 40 degrees and a thickness of 50 $\mu$m is coated on a base as a surface layer.

In FIG. 1, the belt intermediate transfer body 50 supported by rollers 5-1, 5-2, and heating roller 2 rotates in the arrow direction. A pressure roller 3 is provided in contact with the heating roller 2. The heating roller 2 and the pressure roller 3 may be exchanged in their positions, and alternatively the heating roll 3 may have a heating source inside. Four photosensitive bodies 1-1, 1-2, 1-3, and 1-4 are provided around the intermediate transfer body 50, the photosensitive bodies are evenly charged respectively by electrifiers 10-1, 10-2, 10-3, and 10-4, and thereafter exposed by a light beam scanning unit 20 which is switched on and off by a light beam pulse width modulation unit correspondingly to photographic density to form an electrostatic latent image. The electrostatic latent image on the respective photosensitive bodies is developed by developing units 11, 12, 13, and 14 which contain respectively black, yellow, magenta, and cyan toners, respective color toner images of so-called digital image of the photographic density based on area modulation are formed on the respective photosensitive bodies. The respective color toner images are transferred successively onto the intermediate transfer body 50 by the transfer units 50-1, 50-2, 50-3, and 50-4, and a multi-color toner image is formed on the intermediate trasferer body 50.

The pressure roller 3 is, pressed to the heating roller 2 when a recording paper P is fed from a tray 6. Thereafter the intermediate transfer body 50 holding the multi-color toner image and the recording paper P move through between the heating roller 2 and the pressure roller 3 at the matched timing, and pressed and heated. The toner is heated to a temperature higher than melting point and the toner is softened and melted, the toner penetrates into the recording paper, and solidified, and thus the transferring and fixing process is completed. A cooling device 4 cools the intermediate transfer body 50 and the recording paper P both conveyed together from a heating zone, and the toner is solidified by cooling, and adhered strongly on the recording paper P. The intermediate transfer body 50 and the recording paper P cooled by the cooling device 4 are moved and the recording paper P is separated from the intermediate transfer body 50 together with the toner with aid of stiffness of the recording paper itself at the position of the small roller 5-2, and thus a color image is formed. The surface of the toner image transferred and fixed on the recording paper P has the rough structure as rough as that of the surface of the intermediate transfer body 50.

Various inorganic photosensitive materials (Se, a-Si, a-SiC, and CdS) and various organic photosensitive materials may be used for the photosensitive bodies 1-1, 1-2, 1-3, and 1-4.

A color toner contains at least thermoplastic binder resin containing yellow, magenta, or cyan colorant, and known materials may be used as the colorant and binder resin. The above-mentioned exposure condition or development condition is prescribed so that each color toner quantity on a recording paper ranges from about 0.4 mg/cm$^2$ to 0.7 mg/cm$^2$ depending on the colorant content. In this example, the each color toner quantity is prescribed to be 0.65 mg/cm$^2$.

A metal roller or a metal roller having a heat resistant elastic layer consisting of rubber material such as silicone rubber may be used as the heating and pressure rollers. A heating source is provided inside the heating roller, and the heating temperature is prescribed and controlled so that the toner temperature is raised to a temperature higher than the melting point of the toner in the heating zone. The heating zone is prescribed so that the intermediate transfer body 50, toner image, and recording paper P are brought into a tight contact with no partial loose contact and the recording paper P is not creased in the heating zone. A nip pressure in a range from $1\times10^5$ Pa to $1\times10^6$ Pa is preferable for the toner used this time. A roller comprising an aluminum hollow roller and a silicone rubber layer with a hardness of 55 degrees and a thickness of 3 mm coated on the hollow roller is used, a halogen lamp is used as a heating source provided inside the heating roller as the heating and pressure rollers in this example, and the nip pressure is prescribed to be $5.5\times10^5$ Pa.

Just after passing the heating zone, a heating zone exit cooling device 7 is provided so as to be in contact with the recording paper P. The heating zone exit cooling device 7 is provided to lower the toner temperature just after passing the heating zone, the same effect is obtained by cooling not from the paper side but from the intermediate transfer body side just after passing the heating zone. Further, the same effect is obtained by cooling from both sides just after passing the heating zone. The cohesion of toner is increased by cooling to prevent the toner from being offset to the transfer member when the paper P is separated.

The inventors of the present invention examined first the relation between the surface roughness and gloss using an intermediate transfer body having the surface which was evenly roughed variously. To rough evenly the silicone rubber surface, a member having the evenly rough surface was pressed on the silicone rubber surface, that is, embossing method was tried. Actually, wrapping film (brand mane: Imperial wrapping film sheet, product of Sumitomo 3M Ltd.) was pressed on the silicone rubber surface to emboss the wrapping film surface onto the silicone rubber surface. Specifically, silicone rubber (product of Shin-Etsu Chemical Cc., Ltd., silicone rubber KE4895) with a rubber hardness of 40 Hs and silicone rubber (product of Dow Corning Toray Silicon Co., trial product) with a rubber hardness of 65 Hs were coated to form a film with a thickness of about 50 $\mu$m on conductive-treated polyimide belt surface, wrapping film was placed on the surface before curing treatment and pealed off after a certain time, and then the roller was subjected to curing treatment. Intermediate transfer bodies having different surface roughness were prepared by using wrapping film of various types, and by changing the timing to place a film on the silicon rubber surface and pressing time. The relation between the image gloss and the roughness was examined using these embossed intermediate transfer bodies, and the result is shown in FIG. 2.

Instruments used for evaluation are listed herein under.

| | |
|---|---|
| Evaluation machine: | Acolor 935 |
| Toner: | toner for Acolor 935 |
| Paper: | J coat paper, product of Fuji Xerox Co., Ltd. |
| Gloss meter: | product of Murakami Color Research Laboratory<br>Gloss Meter Model GM-26D for 75° |
| Surface roughness meter: | product of Keyence Co.<br>Profile Micrometer VF7500/7510 |

Figure 2:
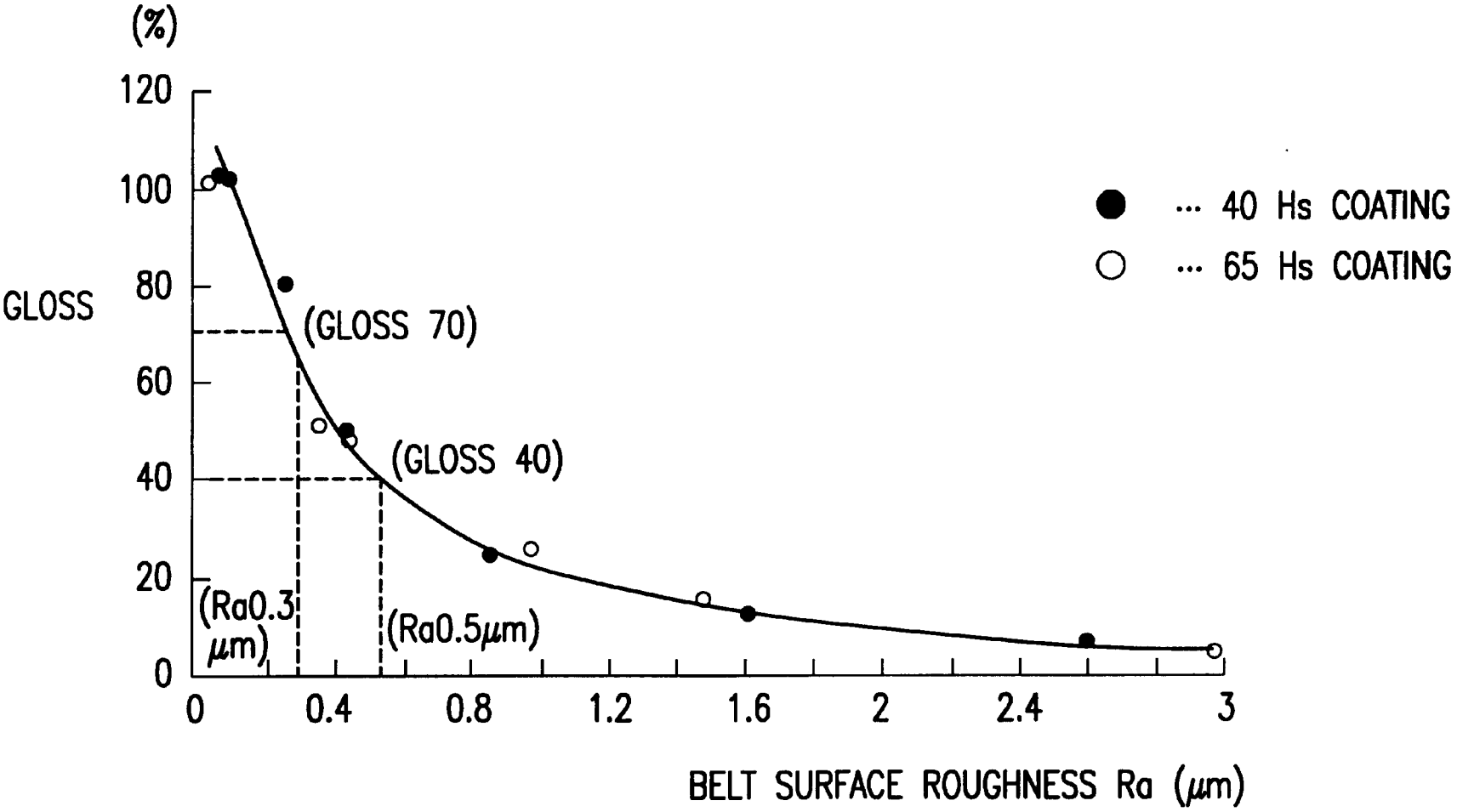
FIG. 2 is a graph for describing the relation between the roughness of an evenly roughed intermediate surface and the image gloss.

FIG. 2 shows the relation between the roughness of the evenly roughed intermediate transfer body surface and image gloss, it is obvious from FIG. 2 that the gloss is not dependent on the hardness of silicone rubber. Little difference is attributed to the fact that a recording medium having an transferred and fixed toner image is separated from an intermediate transfer body after the recording medium is cooled. Currently a color copying machine such as Acolor 935, or Acolor 620, (product of Fuji Xerox Co., Ltd.), or CLC-500, or CLC-700 (product of Canon Inc.) realizes medium grade gloss (40 to 70%). According to FIG. 2, in order to reproduce medium grade gloss (40 to 70%) under the condition that the intermediate transfer body surface is entirely roughed, the center line average roughness Ra should be in a range from 0.3 to 0.5 $\mu$m.

Figure 3:
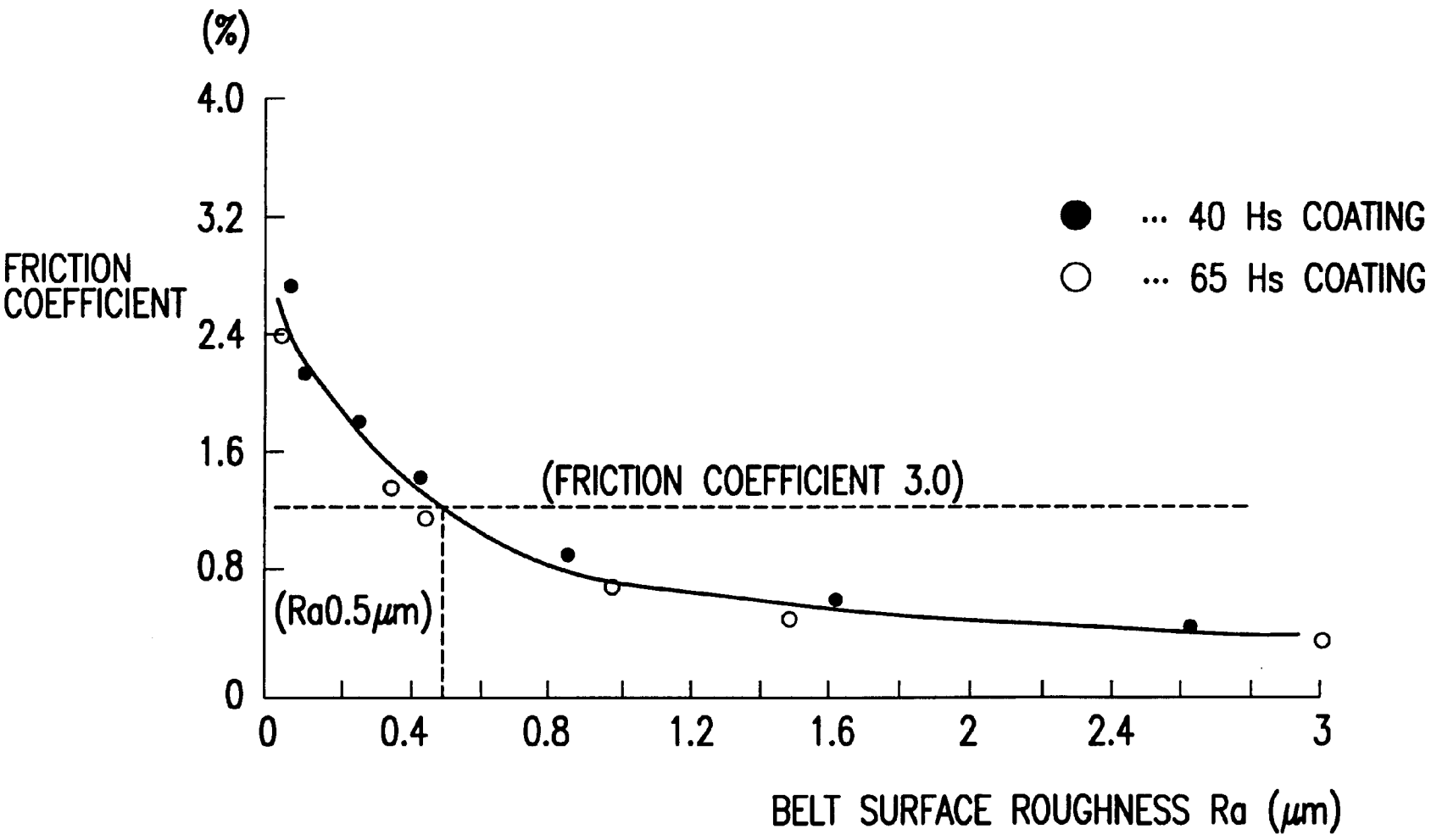
FIG. 3 is a graph for describing the relation between the roughness of an evenly roughed intermediate surface and the friction coefficient between a photosensitive body and the intermediate transfer body.

Next, the friction coefficient between a embossed intermediate transfer body and photosensitive body was measured and the result is shown in FIG. 3. The photosensitive body used was an organic photosensitive body used in Acolor 935 machine, product of Fuji Xerox Co, Ltd. A friction coefficient measurement instrument Peeling/Slipping/Scratching Tester, Heidon-14, product of Heidon Co. was used. The measurement speed was 10 mm/sec and the load was 10 gf/mm.

It was found that the friction coefficient decreased with increasing of Ra. Similarly to the result shown in FIG. 2, the image gloss is independent from the hardness of silicone rubber.

The allowance of the friction coefficient between a intermediate transfer body and photosensitive body will be described.

Figure 4:
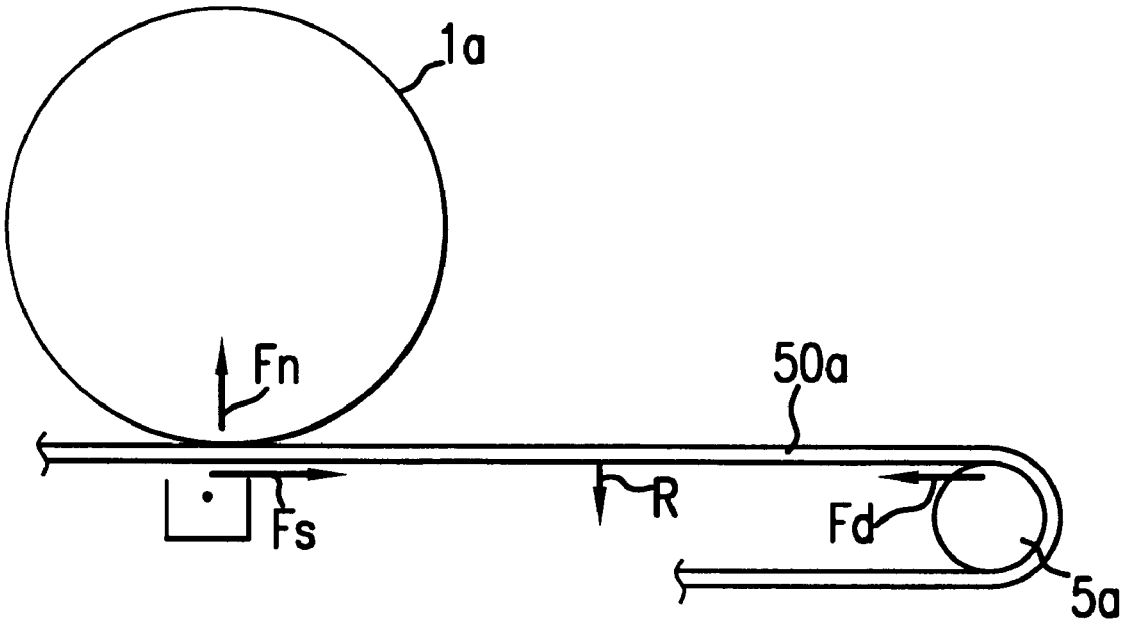
FIG. 4 is a diagram for describing the relation between forces exerted on a photosensitive body, an intermediate transfer body, and an intermediate transfer body driving roller.

FIG. 4 shows the relation between forces exerted on a photosensitive body la, an intermediate transfer body 50*a*, and an intermediate transfer body driving roller 5*a* for driving the intermediate transfer body. The allowance of mechanical working accuracy, which is limited, leads to the speed difference between photosensitive body surface speed and moving speed of the intermediate transfer body belt, and parallelism between the photosensitive body and driving roller is deviated.

The friction force Fs which is determined by the friction coefficient $\mu$ between the photosensitive body and intermediate transfer body as well as transfer pressure Fn is exerted between the photosensitive body and intermediate transfer body. The transfer pressure Fn is the sum of the electrostatic attraction force due to transfer and mechanical pressing force, it is generally said that at least a pressure of 0.5 g/mm$^2$ is required. Between the back side of the intermediate transfer body and the intermediate transfer body driving roller, a conveying force Fd for moving the intermediate transfer body belt is exerted. On the other hand, the intermediate transfer body belt itself has a flexural rigidity R.

The condition that the belt flexural rigidity R is sufficiently large and the friction force Fs is large in comparison with the conveying force Fd leads to slipping between the intermediate transfer body roller and the back side of the intermediate transfer body belt, and slipping results in uncontrollable moving speed of the intermediate transfer belt to cause the dimensional change of an image and color printing deviation. On the other hand, the condition that the belt flexural rigidity R is insufficient though the conveying force Fd is sufficient with respect to the friction force Fs results in waving of the intermediate transfer body belt, and similarly causes uncontrollable moving speed of the intermediate transfer body belt and, dimensional change of an image and color printing deviation.

In Table 1, the controllability for various conditions of friction coefficient $\mu$ between the photosensitive body and the intermediate transfer body as well as the thickness of the belt are shown. It is found that the threshold value is limited due to waving of the intermediate trasferer under the condition of using a thin belt with a low rigidity, on the other hand, the threshold value is limited due to slipping of the intermediate transfer body driving roller under the condition of using a thick belt with a high rigidity, anyway, the friction coefficient should be 1.2 or lower for a copy machine to be controllable. This result was obtained under the condition of the minimum transfer pressure Fn of 0.5 g/mm$^2$. Therefore, a larger Fn requires a lower friction coefficient. Based on the result shown in FIG. 3 of the friction coefficient between the embossed intermediate transfer body and photosensitive body, the intermediate transfer body surface roughness should be larger than 0.5 $\mu$m center line average roughness Ra to obtain the friction coefficient of 1.2 or lower.

TABLE 1

The relation between the friction coefficient between the intermediate transfer body and photosensitive body and the intermediate transfer body running controllability

| Belt base material | Thickness ($\mu$m) | Friction coefficient between the intermediate transfer body and photosensitive body 1.0 | 1.2 | 1.4 | 1.6 |
|---|---|---|---|---|---|
| Polyimide | 50 | ○ | ○ | ▲ | ▲ |
| | 150 | ○ | ○ | ▲ | ▲ |
| | 250 | ○ | ○ | ● | ● |
| Polyester | 50 | ○ | ○ | ▲ | ▲ |
| | 150 | ○ | ○ | ○ | ● |
| | 250 | ○ | ○ | ● | ● |

○ : controllable
▲ : uncontrollable (waving)
● : uncontrollable (slipping)

Figure 5:
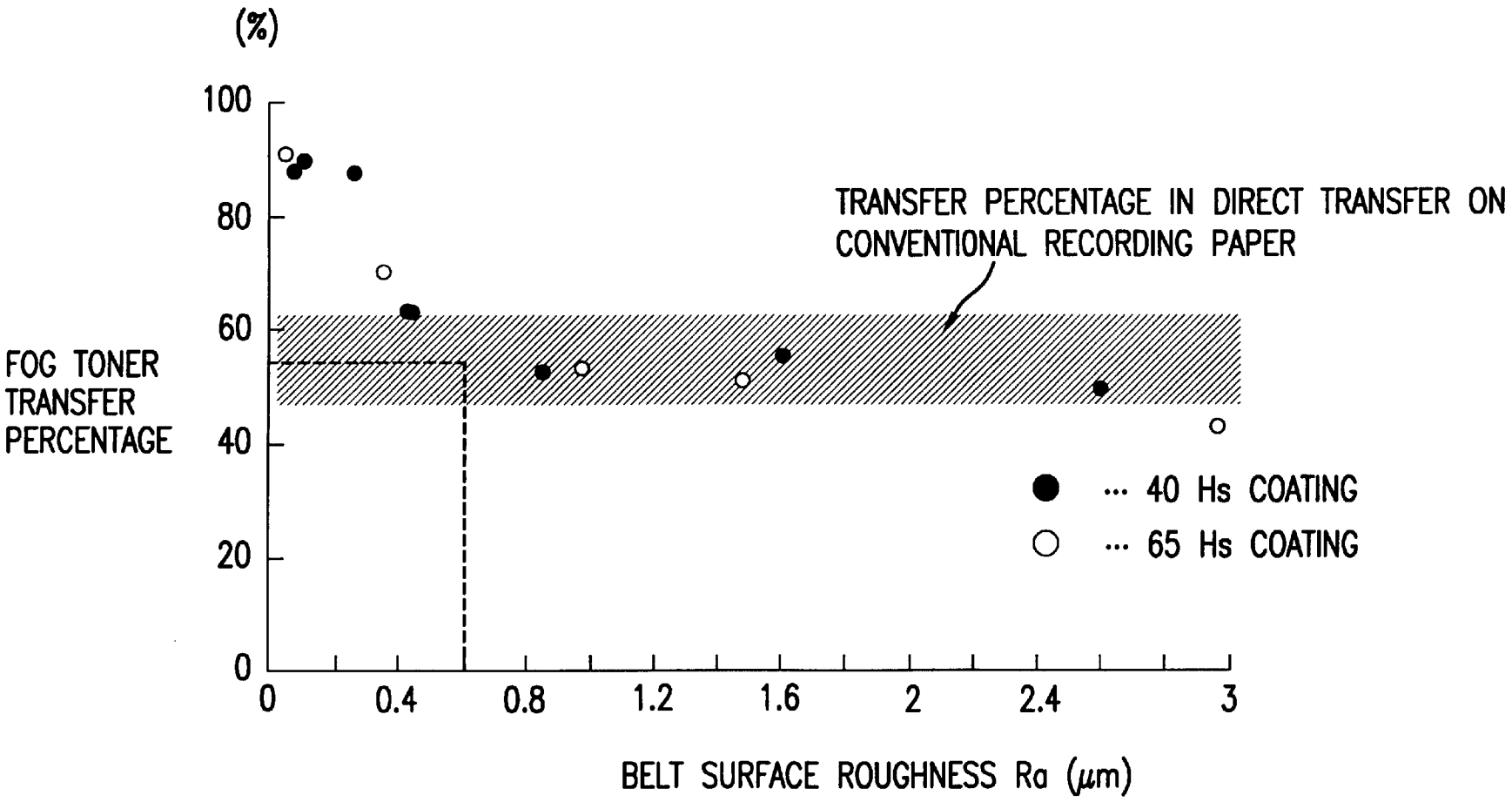
FIG. 5 is a graph for describing the relation between the roughness of the evenly roughed intermediate transfer body surface and the fog toner transfer.

Next, the fog toner transfer of embossed intermediate transfer bodies were measured, and the result is shown in FIG. 5. The hatched portion in the figure indicates the transfer in the conventional case that a toner image is transferred directly onto a recording medium by electrostatic transferring. Therefore, to obtain the same transfer value as conventional, the central average roughness Ra of the intermediate transfer body surface should be about 0.6 $\mu$m or higher.

As shown in FIG. 2 described hereinbefore, to realize the medium gloss (40 to 70%) which is usual for current commercially available color copying machines by evenly roughing the intermediate transfer body surface, the surface central line average roughness Ra should be in a range from 0.3 to 0.5 $\mu$m. If the roughness is prescribed in this range, the friction coefficient of 1.2 or larger is given from FIG. 3, such high friction coefficient results in poor driving running performance of the intermediate transfer body and a high fog toner transfer rate.

On the other hand, if the intermediate transfer body surface is prescribed to be rougher, the friction coefficient of 1.2 or lower is given, and the same fog toner transfer rate as conventional electrostatic transfer or lower is obtained, but the gloss decreases to a rate of 40% or lower.

Next, the result was obtained using an intermediate transfer body having a surface layer which had a surface comprising smooth peaks and recess instead of the intermediate trasferer having evenly roughed surface, and the result will be described.

Figure 6:
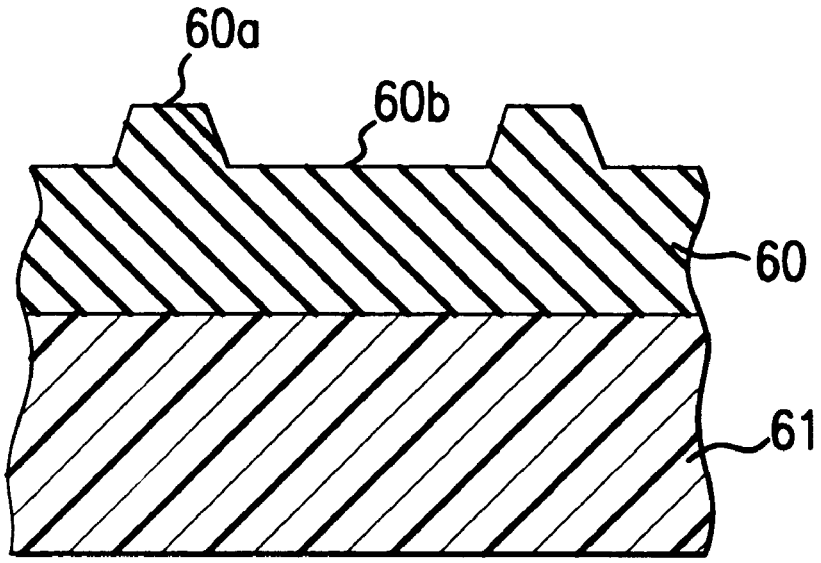
FIG. 6 is a sectional view of an intermediate transfer body surface having the peak area and smooth recess area.
Figure 7:
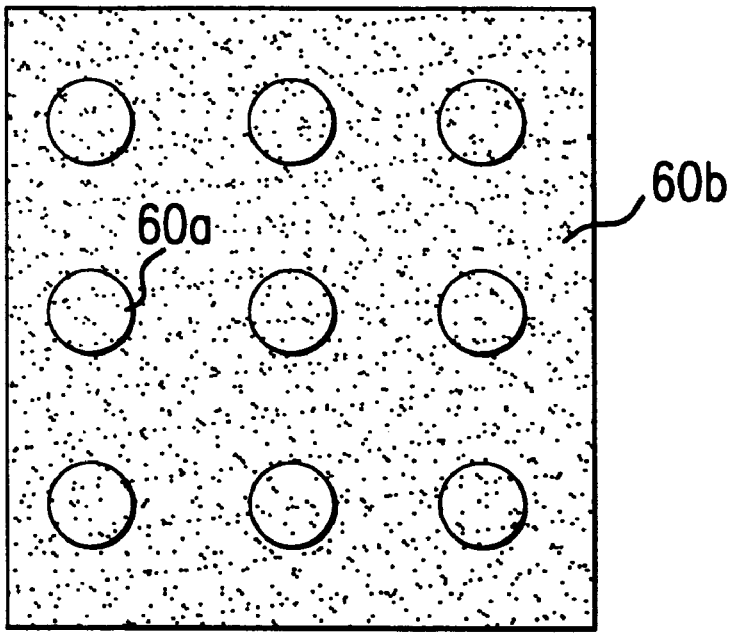
FIG. 7 is a plan view of an intermediate transfer body surface having the peak area and smooth recess area.

FIG. 6 is a sectional view of a belt used in this experiment, and FIG. 7 is a top view. The belt is composed of a polyimide base layer 61 and a silicone rubber surface layer 60, the surface layer is composed of peaks 60*a* and smooth bottom 60*b*. The bottom 60*b* is a smooth surface with a surface roughness of 0.1 $\mu$m or lower.

Figure 8:
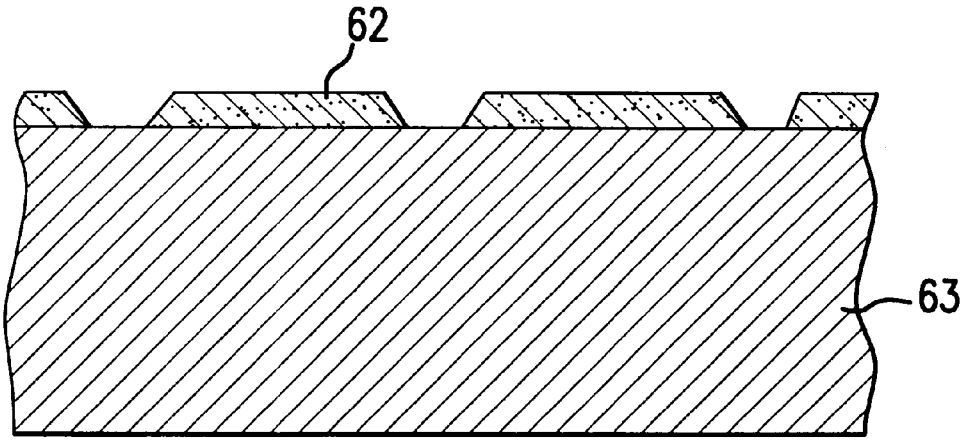
FIG. 8 is a sectional view of an exemplary embossing die for preparing an intermediate transfer body surface having the peak area and smooth recess area.

A method for preparing an embossing die used for obtaining such intermediate transfer body surface will be described hereunder. Usually a metal is processed to form fine recesses on a smooth surface, but the inventors of the present invention employed the transferring fixing method which gives high gloss surface. In detail, an image having blanks at the positions where the peaks in FIG. 7 corresponded and which were to be recesses on a recording paper was transferred and fixed onto the recording paper, the recording paper is used as an embossing die. FIG. 8 shows a cross-section of the paper die. At this time, the interval between holes, depth of holes, and size of holes were adjustedby changing the number of toner plies, the number of lines/inch, and area percentage of a toner image. For example, by using a paper die of one toner color, 200 lines/inch, and toner image area percentage of 85%, intermediate transfer body surfaces having the peak height range from 3 $\mu$m to 4 $\mu$m, interval range from 100 $\mu$m to 125 $\mu$m, and smooth (recess) area percentage range from 85% to 90% were obtained depending on the transferring fixing condition. The surface roughness Ra of the toner image portion 62 of the die is lower than 0.1 $\mu$m, and from the result shown FIG. 2 the gloss of this smooth area exceeds 100% like a mirror surface. Herein, 63 represents the recording paper.

Figure 9:
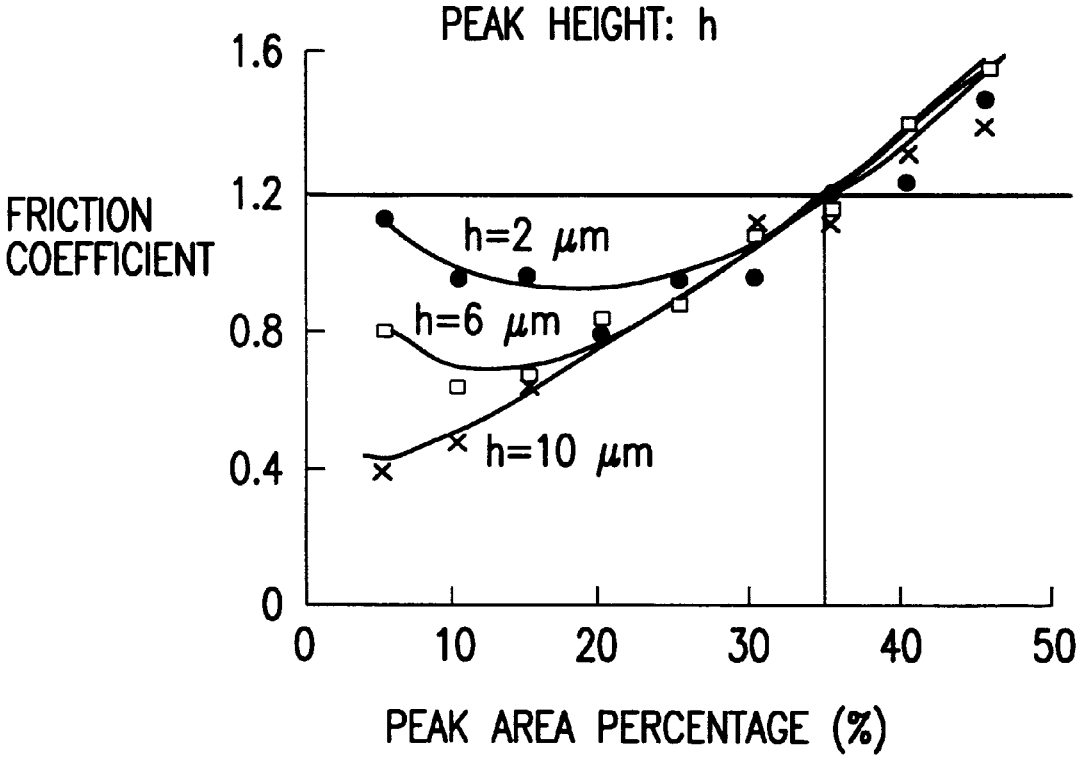
FIG. 9 is a graph for describing the relation between the peak area percentage and the friction coefficient of the intermediate transfer body having the peak area and smooth recess area.

Intermediate transfer bodies coated with silicone rubber with a rubber hardness of 40 Hs were prepared using paper dice prepared as described herein above, and used for measurements. FIG. 9 shows the relation between the friction coefficient between a photosensitive body and the intermediate transfer body, peak area percentage (%), and peak height h ($\mu$m). The relation between the peak area percentage (%) and smooth area (recess) percentage (%) is expressed:

peak area percentage (%)+smooth area (recess) percentage (%)=100 (%).

As shown in FIG. 9, in the range up to the peak area percentage (%) of 20%, the friction coefficient decreases in approximately proportional to the peak area percentage (%). In this range the friction coefficient depends on the contact area between the sensitive body and peak area. On the other hand, in the range lower than 20%, in the case of high peak similarly the friction coefficient decreases in approximately proportional to the peak area percentage (%), but in the case of low peak the friction coefficient increases with decreasing peak area percentage (%). This decrease is likely attributed to the mechanism that the load on each peak increases as the contact area decreases to result in compression of peaks, and in the case of low peaks, the photosensitive body is brought into contact partially with the smooth area to result in increased friction coefficient. Anyway, the peak area percentage (%) should be 35% or lower to suppress the friction coefficient below 1.2.

Figure 10:
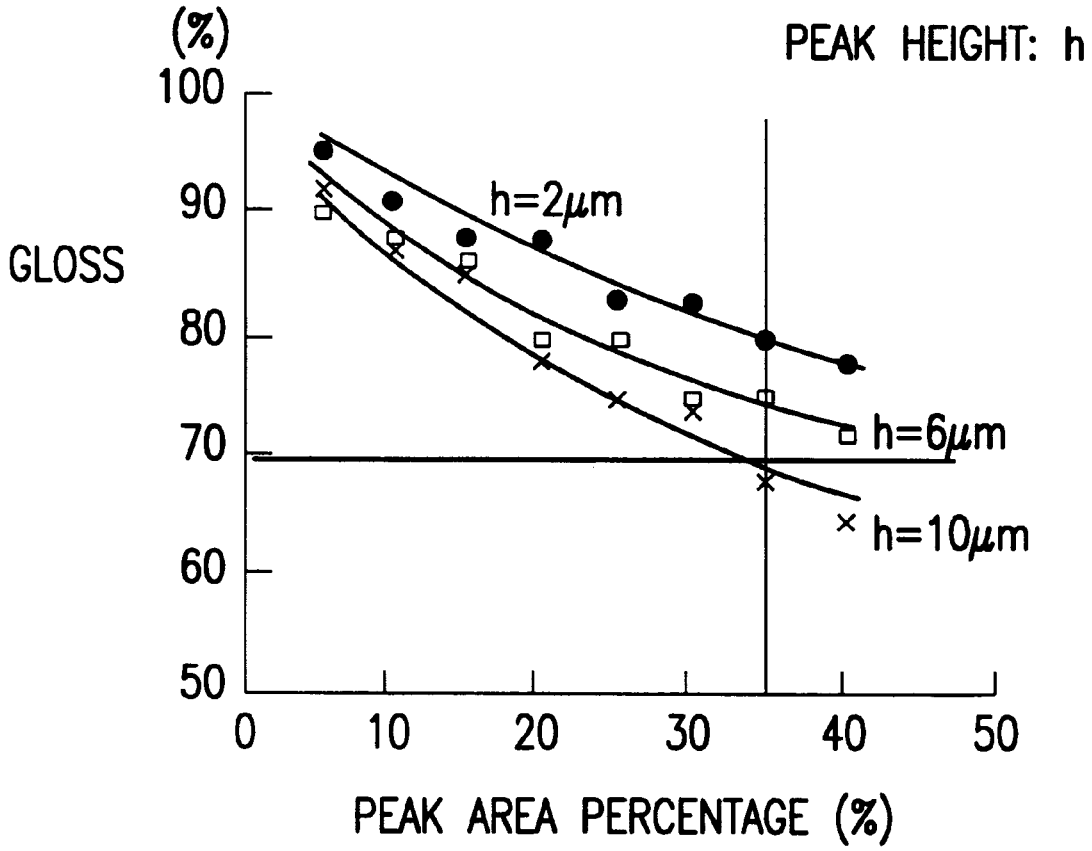
FIG. 10 is a graph for describing the relation between the image gloss, peak area percentage, and peak height of the intermediate transfer body having the peak area and smooth recess area.
Figure 11:
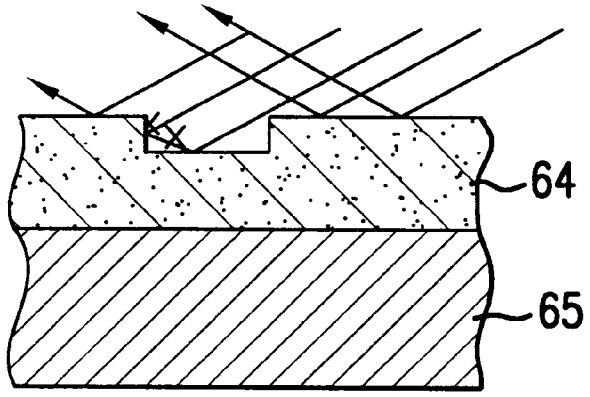
FIG. 11 is a sectional view of a toner image for illustrating light reflection on the toner surface which is formed using an intermediate transfer body having the peak area and roughed recess area.

On the other hand, FIG. 10 shows the relation between the gloss (%), peak area percentage (%), and peak height h ($\mu$m). As shown in FIG. 10, the gloss can be decreased by increasing the peak area percentage (%). Further, the gloss can be decreased by increasing the peak height though slightly. The result is attributed to the reason described herein under. As described hereinbefore, the surface of a toner image 62 has the same convex/concave structure as the surface of the intermediate transfer body as shown in FIG. 11. In detail, the peak area of an intermediate transfer body corresponds to the recess area of a toner image, and the recess area (smooth area) of an intermediate trasferer corresponds to the peak area (surface) of a toner image. The peak area (surface) is very smooth like a mirror surface, and reflects light, a shadow is formed on the wall surface of recess area, reflected light decreases and the gloss decreases. In other words, shadow increases as the length of the wall is long, or as the peak area percentage of an intermediate transfer body increases, and also shadow increases as the wall is high, or as the peak height of an intermediate transfer body increases. The gloss changes probably due to the mechanism as described hereinabove.

As shown in FIG. 10, the gloss is 70 or higher in the peak area percentage (%) of 35% or higher, in which range the friction coefficient condition of 1.2 or lower is satisfied. The gloss can be decreasedby increasing the peak height, however, the high peak height causes poor transfer of a toner image from the photosensitive body. The peak height of 10 μm shown in FIG. 10 causes slightly poor transfer, therefore the peak height of 10 μm is the limit.

In spite of using an intermediate trasferer having the smooth surface on which peaks are formed as described hereinabove, the medium gloss (40 to 70%), which is realized in commercially popular color copy machines, cannot be realized under the condition that the friction coefficient is 1.2 or lower.

The inventors of the present invention addressed on the fact that the gloss depended on the recess area (smooth area) of the intermediate transfer body but the friction coefficient did not depend on the recess area (smooth area) of the intermediate transfer body, and considered that an intermediate transfer body having roughed recess area was promising.

Figure 12:
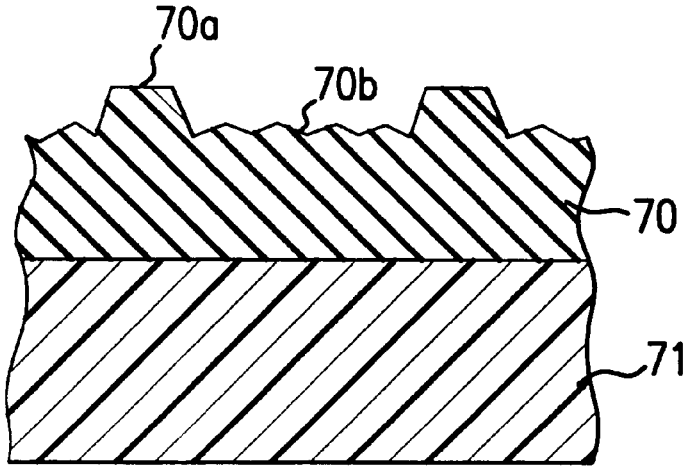
FIG. 12 is a sectional view of an intermediate transfer body surface having the peak area and roughed recess area.
Figure 13:
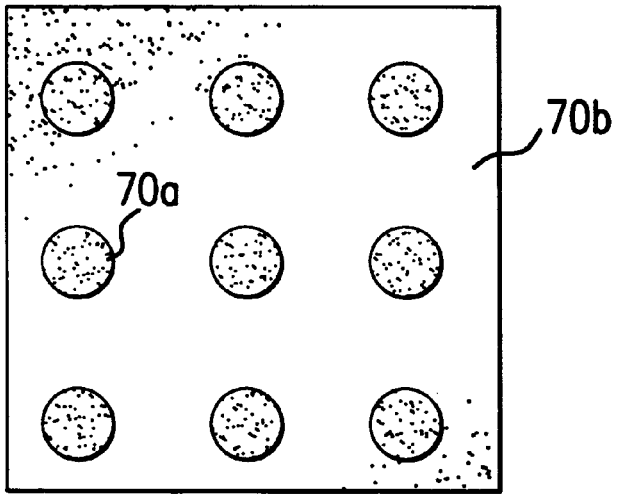
FIG. 13 is a plan view of an intermediate transfer body surface having the peak area and roughed recess area.
Figure 14:
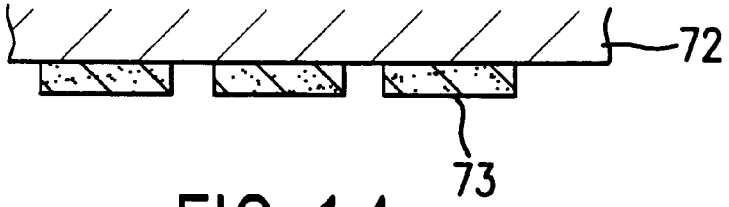
FIG. 14 is a sectional view of an intermediate transfer body surface having a toner image of a shape corresponding to the recess area of an intermediate transfer body in the process of preparing the intermediate transfer body.
Figure 15:
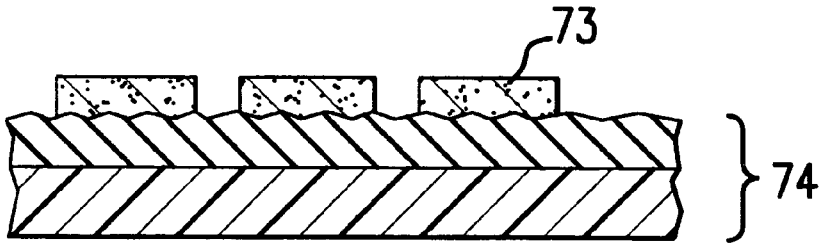
FIG. 15 is a sectional view of an intermediate transfer body surface formed by transferring a toner image shown in FIG. 14 onto an evenly entirely roughed surface in the process of preparing an intermediate transfer body.
Figure 16:
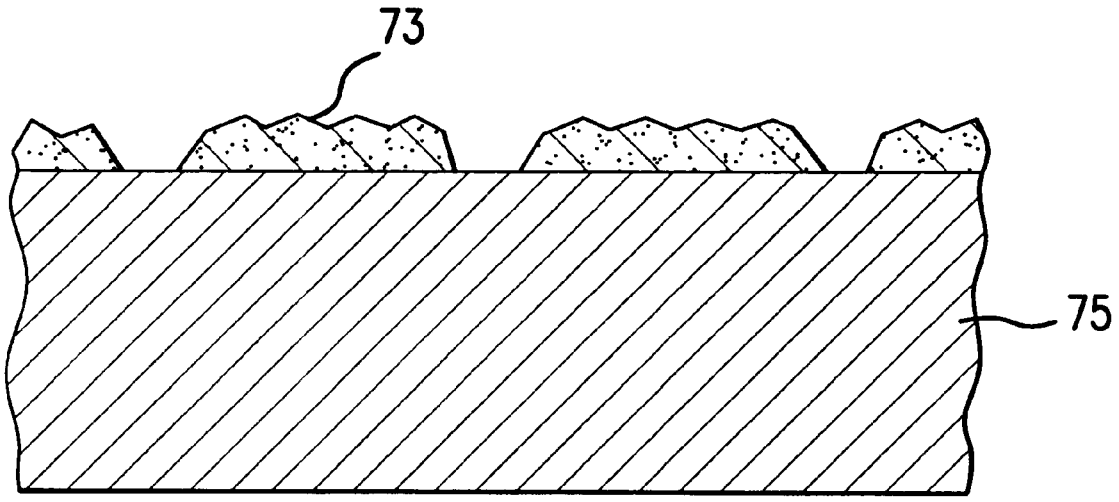
FIG. 16 is a sectional view of recording paper on which a toner image shown in FIG. 15 is transferred and fixed in the process of preparing an intermediate transfer body.

FIG. 12 shows a cross-sectional view of an intermediate transfer body of the present invention, and FIG. 13 is a top view. The intermediate transfer body comprises a polyimide base layer 71 and a silicone rubber surface layer 70 coated on the base 71. The surface layer of the silicone rubber comprises peak areas 70*a*, each defining a plateau, and recess area 70*b*. As shown in FIG. 12, the recess area 70*b* is rough and includes peaks and valleys. FIG. 12 also shows that the peak areas 70*a* are elevated above the roughed recess area 70*b*. First, a method for preparation of an embossing die used for obtaining the intermediate transfer body surface as described hereinabove will be described. In detail, as shown in FIG. 14, an electrostatic latent image corresponding to the recess area 70b of the final intermediate transfer body was formed as shown in FIG. 14, and developed using toner to form a toner image 73 (therefore, on the portion corresponding to the recess area 70*a* of the final transfer body, there was no image). Next, as shown in FIG. 15, the above-mentioned toner image 73 was transferred electrostatically onto the rough surface of an intermediate transfer body 74 having the surface evenly roughed entirely. The toner image 73 adhered on the rough surface with aid of electrostatic force and cohesive force. Then, the image holding surface of the intermediate transfer body 74 on which the toner image 73 had been transferred was thermally pressed on a recording paper 75, the toner image 73 was transferred and fixed on the recording paper 75 to obtain an embossing die having a cross-section as described in FIG. 16. By pressing the die on unvalcanized silicone rubber, an intermediate transfer body having the surface on which peak areas 70*a* were arranged on the roughed recess area 70*b* mixedly as shown in FIG. 12 was obtained. The interval between holes, depth of holes, and size of holes were adjusted variously by chancing the number of toner plies, number of lines/inch, and toner image area percentage.

Figure 17:
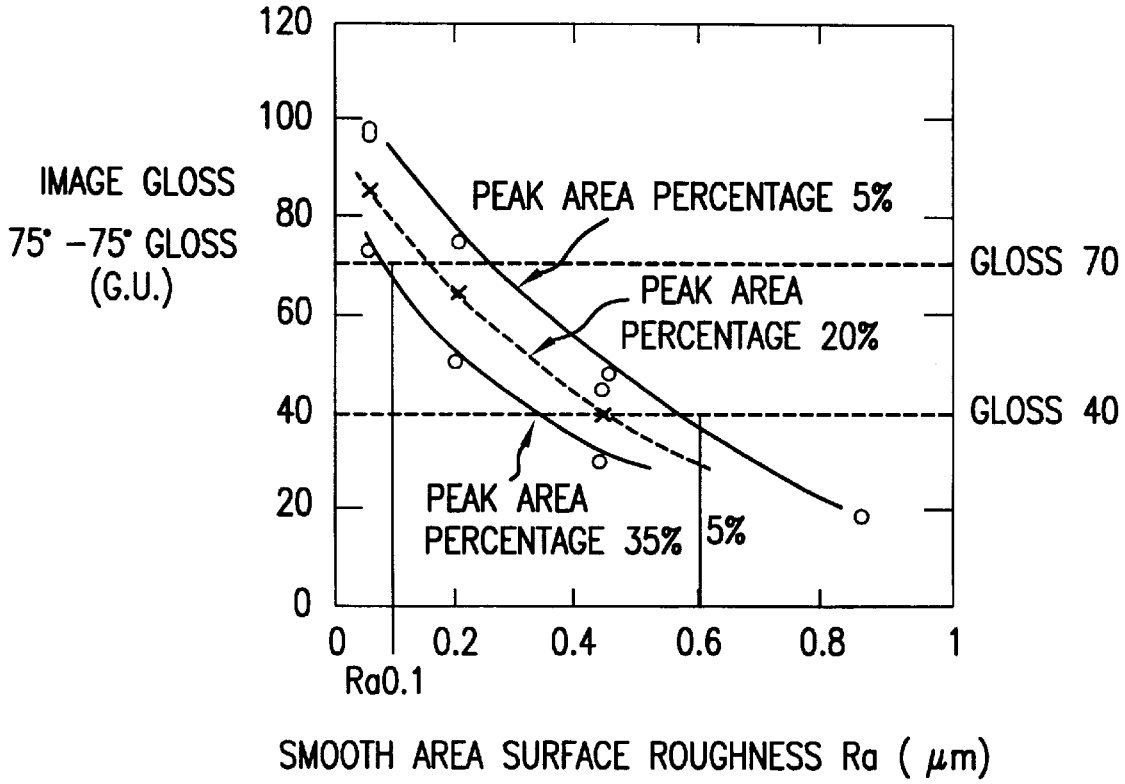
FIG. 17 is a graph for describing the relation between the image gloss, surface roughness of the recess area, and peak area percentage of the intermediate transfer body having the peak area and roughed recess area.
Figure 18:
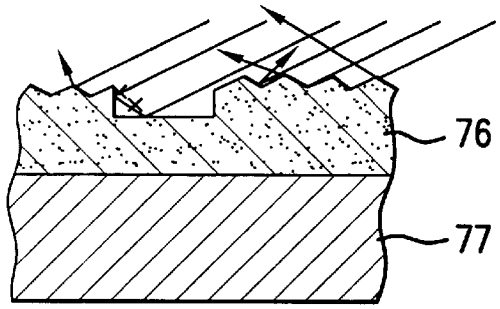
FIG. 18 is a sectional view of a toner image formed using an intermediate transfer body having the peak area and roughed recess area for describing light reflection on the toner surface.

In FIG. 17, the relation between the gloss, central line average roughness Ra of the recess area of the intermediate transfer body, and peak area percentage (%) is shown. As shown in FIG. 17, the gloss decreases with increasing the central line average roughness Ra of the recess area of the intermediate transfer body. It is found that the gloss can be adjusted by changing the surface roughness of the recess area of the intermediate transfer body. The result is likely attributed to the reason described hereunder. As described hereinabove, the surface of the toner image transferred and fixed on a recording paper has the same convex/concave structure as the surface of an intermediate transfer body. In other words, the recess area of an intermediate transfer body corresponds to the peak area (surface) of a toner image. The roughed recess area of an intermediate transfer body renders the recess area (surface) of a toner image transferred onto a recording paper 77 rough as shown in FIG. 18, and the smooth surface like mirror is reduced and the gloss is reduced.

The friction coefficient of an intermediate transfer body having the peak area and roughed recess area agrees with the friction coefficient of an intermediate transfer body having the smooth recess area and peak area shown in FIG. 9. It is confirmed that the friction coefficient depends on the peak area percentage (%) of the intermediate transfer body and does not depend on the recess area of the intermediate transfer body as intended.

Accordingly, as shown in FIG. 17, under the condition that the peak area percentage is 35% or lower, which results in the friction coefficient of 1.2 or lower, whereas the smooth recess area of an intermediate transfer body like a mirror surface with a central line average roughness Ra of lower than 0.1 μm results in the high gloss value of 70 (%) or higher, the roughed recess area of an intermediate transfer body with a central line average roughness Ra of 0.1 μm or higher results in the low gloss value of 70 (%) or lower. Further, the roughed recess area with a central line average roughness Ra of 0.6 μm or higher results in the gloss of 40 (%) or lower. After all, to achieve the medium gloss (40 to 70%), which is usual for currently available popular color copying machines, Ra of the recess area is adjusted to be in a range from 0.1 to 0.6 μm.

The peak area percentage on an intermediate transfer body surface ranges preferably from 3 to 35%, more preferably from 10 to 30%, and the most preferably from 10 to 20%.

It is confirmed that the friction coefficient of an intermediate transfer body having roughed recess area and peak area as described hereinabove depends on the peak area percentage (%) of the intermediate transfer body and does not depend on the recess area of the intermediate transfer body, further, from the experiment, the same result as the one obtained by using an intermediate transfer body having the smooth recess area and peak area was obtained for the fog toner transfer. It was found that the fog toner transfer depended on the peak area which was brought into contact with the photosensitive body and did not depend on the recess area of the intermediate transfer body.

Figure 19:
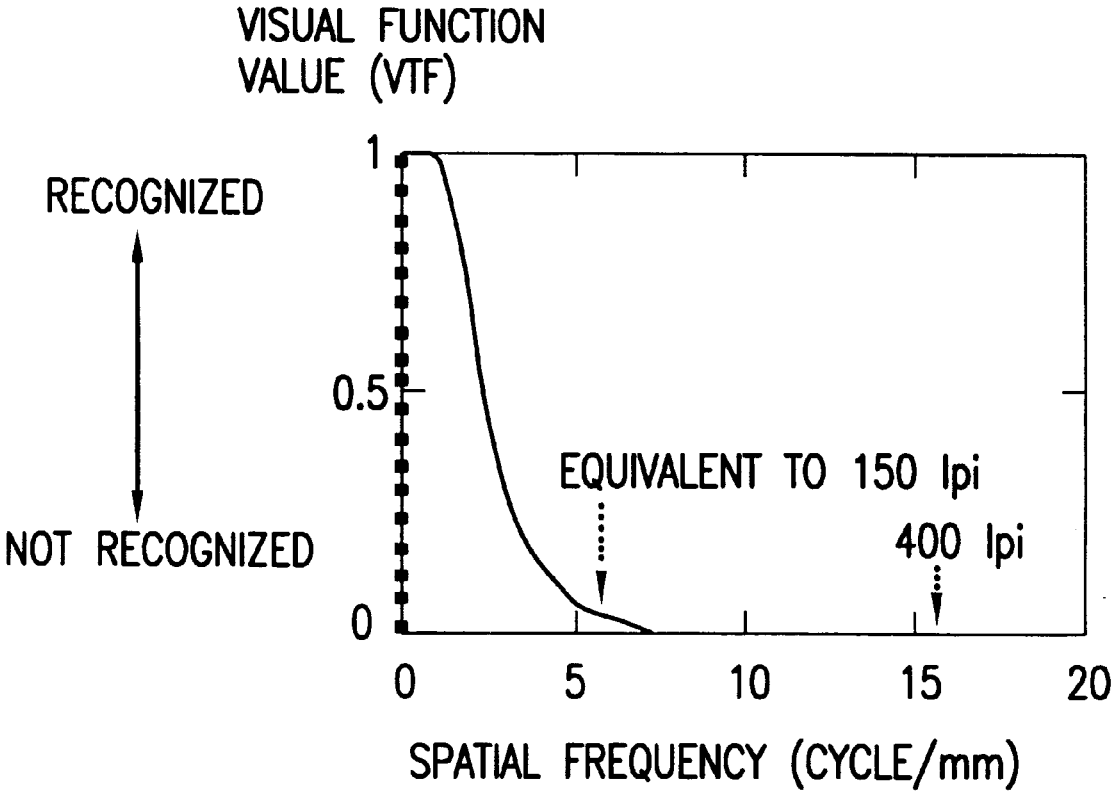
FIG. 19 is a graph for describing the relation between the spatial frequency and the visual function value.

The important point to be considered here is that a peak of an intermediate transfer body surface forms a recess on the surface of a toner image on a recording medium. Usually, with reference to the visual function (VTF) shown in FIG. 19, the spatial frequency of at least 150 lines/inch is required in order to be invisible. In other words, the interval between a peak and recess is preferably 170 μm or shorter. As the result of sensory evaluation, it was found that the interval of 200 μm was allowable visually because it was not so remarkable though it was recognizable visually. This problem is solved by prescribing the interval to be 200 μm or shorter. The shorter interval between a peak and recess equal to or shorter than the toner diameter results in contact of toner with only the peak but no contact with the recess and results in increased fogging unpreferably. After all, the interval between apeak and recess preferably ranges from the toner particle diameter to 200 μm.

Figure 20:
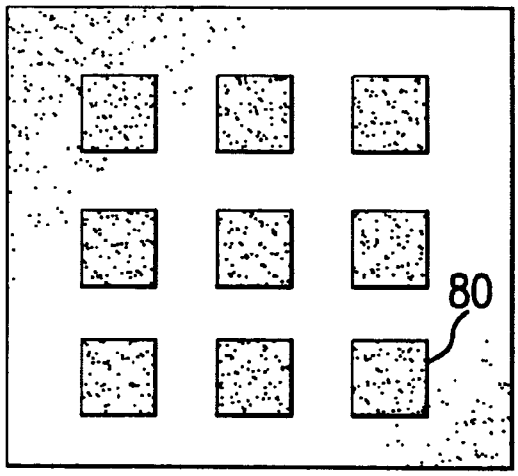
FIG. 20 is a top view for illustrating an intermediate transfer body having the rectangular peak area.
Figure 21:
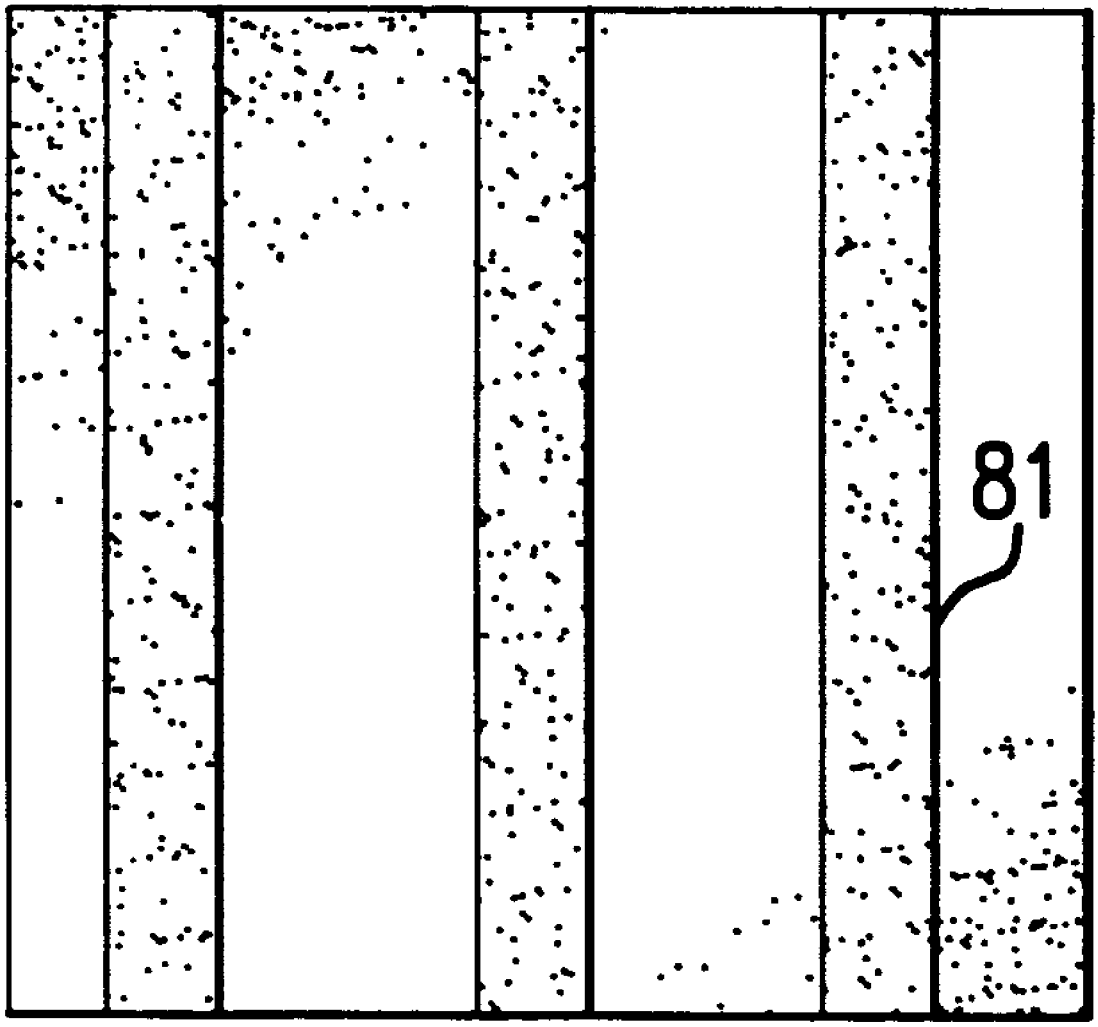
FIG. 21 is a top view for illustrating an intermediate transfer body having the linear ridge area.

The circular peak is used as the peak shape in the above-mentioned description, however the peak shape is by no means limited to the circular shape, and may be rectangular peak 80 as shown in FIG. 20. Further, it may be triangular, pentagon, rhomboid, or ellipse. Alternatively, it may be linear ridge 81 as shown in FIG. 21.

According to the present invention involving an image forming apparatus for transferring and fixing a toner image from a photosensitive body onto a recording medium using an intermediate transfer body having the surface of a material such as silicone rubber for improve the toner releasing and image quality, an intermediate transfer body and an image forming apparatus which realize the medium gloss (40 to 70%), which currently available popular color copy machines reproduce, allow easy driving and running control of the intermediate transfer body by reducing the friction coefficient between the photosensitive body and the intermediate transfer body, and prevent the image quality deterioration by reducing the fog toner transfer are provided.

What is claimed is:

1. An intermediate transfer body which receives a toner image held on a toner image holder and transfers again the toner image onto a recording medium to form an image on said recording medium, wherein the surface of said intermediate transfer body for receiving said toner image has roughed recess area including peaks and valleys and at least one peak area defining a plateau, elevated above the roughed recess area the plateau of the at least one peak area defining 10 to 30% of the surface of the intermediate transfer body.

2. The intermediate transfer body as claimed in claim 1, wherein the central line average roughness Ra of said roughed recess area is in a range from 0.1 $\mu$m to 0.6 $\mu$m.

3. The intermediate transfer body as claimed in claim 1, wherein the interval between said peak and recess is in a range from the toner particle diameter to 200 $\mu$m.

4. An image forming apparatus provided with an electrostatic latent image carrier, electrostatic latent image forming means for forming an electrostatic latent image on said electrostatic latent image carrier, developing means for developing said electrostatic latent image formed on said electrostatic latent image carrier with toner to form a toner image, an intermediate transfer body, transfer means for performing first transfer of said toner image onto said intermediate transfer body, and second transfer means for transferring said toner image formed on said intermediate transfer body onto said recording medium at least by heating, wherein said intermediate transfer body is the intermediate transfer body as claimed in claim 1.

5. The image forming apparatus as claimed in claim 4, wherein the central line average roughness Ra of said roughed recess area is in a range from 0.1 $\mu$m to 0.6 $\mu$m.

6. The image forming apparatus as claimed in claim 4, wherein the interval between said peak and recess is in a range from the toner particle diameter to 200 $\mu$m.

* * * * *